US006621458B1

(12) United States Patent
Petros et al.

(10) Patent No.: US 6,621,458 B1
(45) Date of Patent: Sep. 16, 2003

(54) COMBINATION LINEARLY POLARIZED AND QUADRIFILAR ANTENNA SHARING A COMMON GROUND PLANE

(75) Inventors: Argy Petros, Lake Worth, FL (US); Terry C. Helstrom, Boynton Beach, FL (US)

(73) Assignee: XM Satellite Radio, Inc., Washington, DC (US)

( * ) Notice: Subject to any disclaimer, the term of this patent is extended or adjusted under 35 U.S.C. 154(b) by 0 days.

(21) Appl. No.: 10/114,360

(22) Filed: Apr. 2, 2002

(51) Int. Cl.[7] ..... H01Q 21/00; H01Q 1/36

(52) U.S. Cl. ..... 343/725; 343/700 MS; 343/895

(58) Field of Search ..... 343/700 MS, 725, 343/895, 790, 791, 821, 846, 848, 853

(56) References Cited

U.S. PATENT DOCUMENTS

| | | | | | |
|---|---|---|---|---|---|
| 3,100,893 | A | | 8/1963 | Brueckmann | 333/32 |
| 3,750,181 | A | | 7/1973 | Kuecken | 343/790 |
| 4,349,824 | A | | 9/1982 | Harris | 343/700 MS |
| 4,963,879 | A | | 10/1990 | Lin | 343/792 |
| 5,134,422 | A | | 7/1992 | Auriol | 343/895 |
| 5,198,831 | A | | 3/1993 | Burrell et al. | 343/895 |
| 5,349,365 | A | | 9/1994 | Ow et al. | 343/895 |
| 5,541,617 | A | | 7/1996 | Connolly et al. | 343/895 |
| 5,828,348 | A | * | 10/1998 | Tassoudji et al. | 343/895 |
| 5,838,285 | A | * | 11/1998 | Tay et al. | 343/895 |
| 5,986,616 | A | * | 11/1999 | Edvardsson | 343/853 |
| 5,986,620 | A | | 11/1999 | Filipovic | 343/895 |
| 6,005,521 | A | | 12/1999 | Suguro et al. | 343/700 MS |
| 6,072,441 | A | * | 6/2000 | Tanabe | 343/895 |
| 6,150,981 | A | | 11/2000 | Suguro et al. | 343/700 MS |
| 6,229,499 | B1 | | 5/2001 | Licul et al. | 343/895 |
| 6,421,026 | B2 | * | 7/2002 | Nishino et al. | 343/860 |
| 6,480,173 | B1 | * | 11/2002 | Marino | 343/895 |
| 6,483,471 | B1 | * | 11/2002 | Petros | 343/725 |

* cited by examiner

*Primary Examiner*—Tan Ho
(74) *Attorney, Agent, or Firm*—Akerman Senterfitt

(57) ABSTRACT

A combination linearly polarized antenna and quadrifilar helix antenna (30) comprises a flexible substrate (50), a quadrifilar antenna (33) with a feed network (34) etched on a first portion of the flexible substrate, an antenna with linear polarization (35) etched on a second portion of the flexible substrate and a ground plane (36) for both the quadrifilar antenna and the antenna with linear polarization etched on the flexible substrate.

22 Claims, 5 Drawing Sheets

Monopole/Quadrifilar

Prior Art

Combination Antenna Description

40

COMBINATION LINEARLY POLARIZED AND QUADRIFILAR ANTENNA SHARING A COMMON GROUND PLANE

CROSS-REFERENCE TO RELATED APPLICATIONS (not applicable)

FIELD OF THE INVENTION

The invention relates generally to a combination quadrifilar and linearly polarized antenna, and more particularly to a combination linearly polarized and quadrifilar antenna able to provide excellent performance for both antennas in a low profile arrangement.

BACKGROUND OF THE INVENTION

Charles D. McCarrick describes a combination monopole/quadrifilar helix antenna for S-band/Satellite applications on page 330 of the May 2001 edition of the Microwave Journal. FIG. 1 illustrates the monopole/ quadrifilar antenna 10 discussed in the McCarrick article. The antenna 10 includes a monopole 15 whose reflective element is a quarter-wave choke 14. Elements 14 and 15 form dipole antenna 13. The antenna 10 comprises a coaxial line 12 with a section of the outer conductor removed to expose the center conductor 15. The quarter-wave choke 14 is placed within a quadrifilar helix antenna shell 16 in an axially concentric fashion. The quadrifilar helix antenna is typically phased to produce circular polarization. Appropriate placement of the dipole antenna 14 within the quadrifilar antenna is critical for avoiding coupling between the two antennas and avoiding degradation of radiation patterns.

A combined antenna as described above has the disadvantages of having strict design requirements in terms of relative placement between antennas to avoid interference between the antennas and further requires a wider overall structure that may not necessarily be aesthetically pleasing. It is very difficult to optimize due to interactions between the dipole and quadrifilar helix. Furthermore, it is a mechanically-challenging structure and difficult to manufacture. The typical placement for such a combined antenna would be on the sloping back windshield of a vehicle. In this instance, for good satellite reception, care must be taken to ensure that most of the quadrifilar antenna "clears" the line of sight with the transmitting satellite that may be blocked by the roof of the vehicle.

A combination linearly polarized/quadrifilar helix antenna 40 is illustrated in FIG. 2 as described in an application filed Jun. 6, 2001 and having application Ser. No. 09/875,728, now U.S. Pat. No. 6,483,47 which is incorporated by reference and assigned to the Assignee herein. It consists of a tubular dipole antenna 44 that is placed coaxially underneath the quadrifilar helix, but it should be noted that other types of dipole antennas, patches, or loop antennas (being linearly polarized) could easily replace the tubular dipole antenna. A (first) coaxial cable 46 is passed through the new tubular dipole with minimum effect on its performance. That coaxial cable 46 is connected to a feed network 48 of the quadrifilar helix antenna 49 and to a ground plane (residing behind the feed network 48-not shown) of the quadrifilar helix antenna 49. It should be noted that feed network 48 and quadrifilar shell 47 form the quadrifilar helix antenna 49. A (second) coaxial cable 42 preferably couples to a quarter wave hollow metal tube coupled to an inner conductor of coaxial cable 42 forming the tubular dipole antenna 44. The outer conductor of cable 42 (shield) is physically connected to the outer conductor (shield) of cable 46 and both are also connected to the shorted top section of tube 45. This configuration results in excellent performance for both antennas. Coaxial cable 46 has a minimum effect on dipole 44 due to the dipoles tubular structure. Also, this configuration results in minimum interaction between quadrifilar antenna 49 and dipole 44, but note that the dipole uses a separate tube to serve as a ground plane for the dipole antenna. Although helix antenna 40 does provide excellent performance and is simpler to construct than the antenna of FIG. 1, the quadrifilar antenna and the linearly polarized antenna of the combination do not share the same RF ground plane and is not fully integrated on a flexible substrate to provide further ease of assembly.

Thus, a need exists for a combined linearly polarized and quadrifilar antenna that will enable designers further freedom in the relative placement of the antennas while avoiding the detriments of coupling and interference between the antennas and further provide ease of assembly. Further, a need exists for a combined antenna that is esthetically pleasing that will be formed in a manner sharing a common ground plane.

SUMMARY

In a first aspect of the present invention, a combination linearly polarized antenna and quadrifilar helix antenna comprises a flexible substrate, a quadrifilar antenna with a feed network etched on a first portion of the flexible substrate, an antenna with linear polarization etched on a second portion of the flexible substrate and a ground plane for the quadrifilar antenna and the antenna with linear polarization etched on the flexible substrate.

In a second aspect of the present invention, a combination monopole and quadrifilar helix antenna comprises a quadrifilar antenna having a feed network and a monopole antenna arranged below the quadrifilar antenna, wherein the monopole and the feed network share a common ground plane and wherein the monopole is at least partially below the common ground plane.

In a third aspect of the present invention, a method of manufacturing a combination monopole and quadrifilar antenna comprises the steps of forming a quadrifilar antenna pattern with a feed network on at least a first plane of a flexible substrate, forming a monopole antenna pattern on at least the first plane of the flexible substrate, and forming a ground plane pattern on at least a substantial portion of a second plane of the flexible substrate.

DETAILED DESCRIPTION OF THE DRAWINGS

Figure 1:
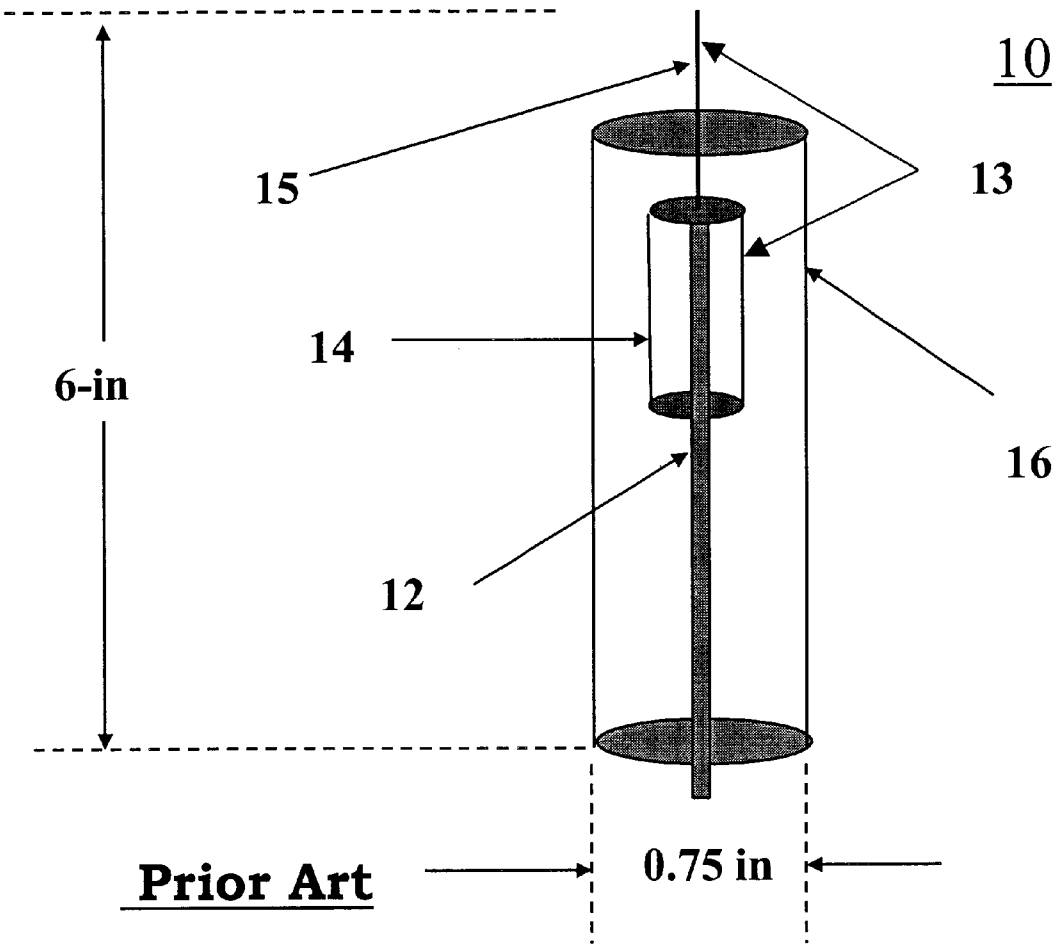
FIG. 1 illustrates an existing monopole/quadrifilar antenna.
Figure 2:
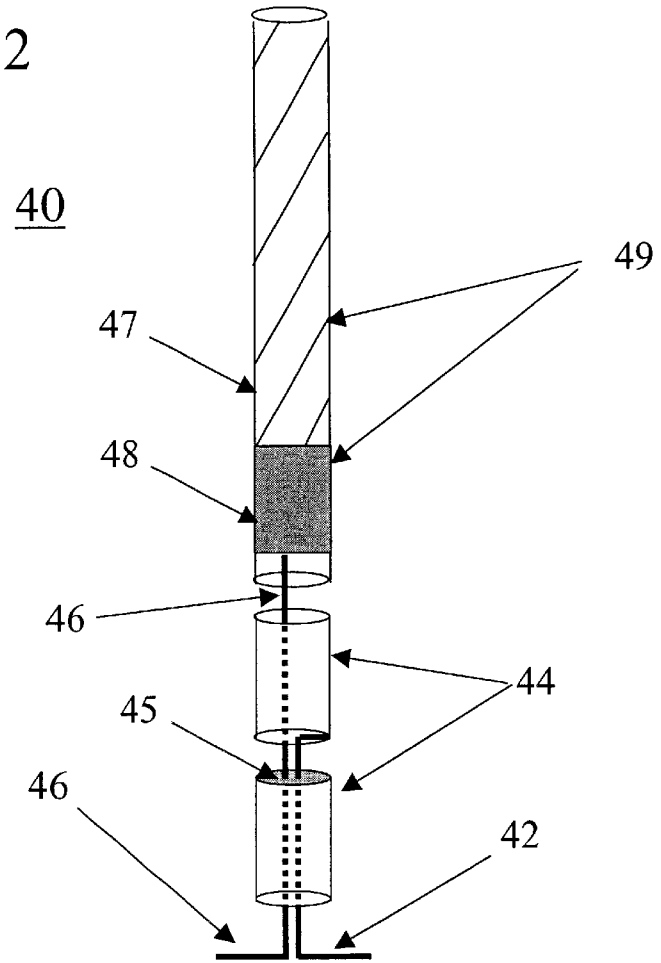
FIG. 2 is a diagram illustrating the combination of a quadrifilar and dipole antenna.
Figure 3:
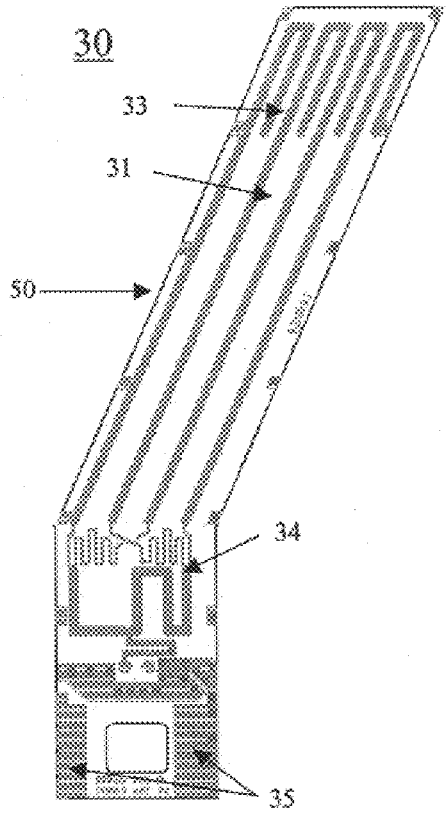
FIG. 3 is a front plan view of a flexible substrate used for a combined linearly polarized and quadrifilar antenna in accordance with the present invention.
Figure 4:
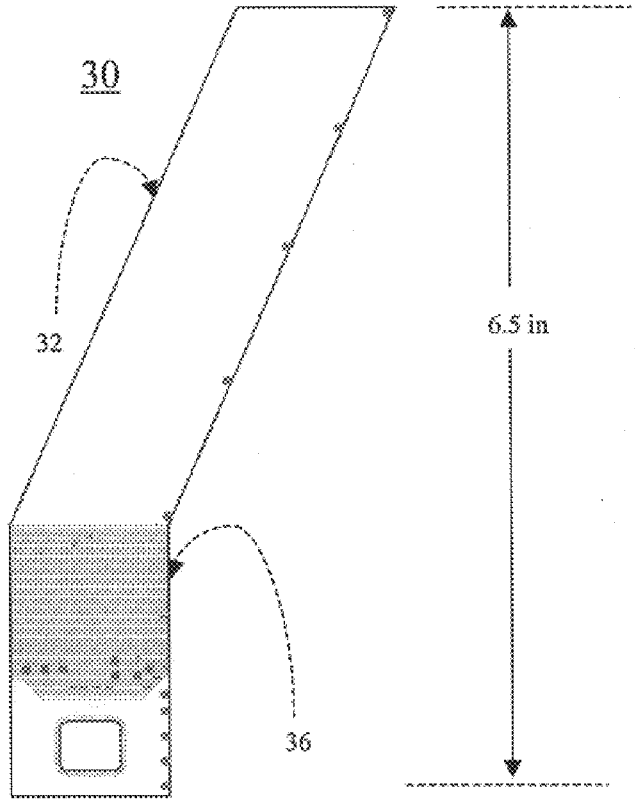
FIG. 4 is a "see-through" or rear view of the flexible substrate of FIG. 3 illustrating the common ground plane in accordance with the present invention.

Referring to FIG. 3, a front plan view of a front side 31 of a substrate 50 used for a combination linearly polarized antenna and quadrifilar helix antenna 30 is shown. The antenna preferably comprises a quadrifilar antenna 33 with a feed network 34 etched on a first or top portion of the flexible substrate 50. The quadrifilar antenna 33 is preferably a "folded quadrifilar" with radiating members that fold in parallel fashion as shown and as known in the art to further reduce the overall profile of the antenna 30. It should be understood that the present invention is not necessarily limited to a folded quadrifilar antenna and that an unfolded, albeit taller, antenna is still within contemplation of the present invention as will be shown with reference to FIG. 7. The antenna 30 further preferably comprises an antenna with linear polarization 35 such as a monopole etched on a second or bottom portion of the flexible substrate 50. The antenna 30 also comprises a ground plane 36 that is common for the quadrifilar antenna and the antenna with linear polarization as shown in FIG. 4. The ground plane is etched on the flexible substrate and preferably on an opposing side 32 of the substrate 50. As shown in FIGS. 3 and 4 the quadrifilar antenna 33 and the antenna with linear polarization 35 are etched on a first side of the flexible substrate 50 and a substantial portion of the ground plane 36 is etched on an opposing side of the flexible substrate. It should be further noted that the combination antenna 30 is arranged and constructed to fold to form at least a portion of a tube and wherein the antenna with linear polarization and the ground plane have uncoupled portions that become coupled once the combination is folded around to form the tube. Once formed in a tube, the monopole antenna can be formed below the quadrifilar antenna, wherein the monopole and the feed network share a common ground plane and wherein the monopole is at least partially below the common ground plane. In should further be noted that the antennas of FIGS. 3–7 in comparison to the antenna of FIG. 2 has an "inverted" ground plane and feed point (for the linearly polarized antenna) where the feed point for the linearly polarized antenna is arranged near the bottom of the ground plane and the antenna runs vertically down from the feed point and away from the ground plane. This "inversion" of the ground plane and feed point of the linearly polarized antenna allows the quadrifilar antenna of FIGS. 3–7 to share this common ground plane with the linearly polarized antenna, not previously possible in other existing arrangements.

Figure 5:
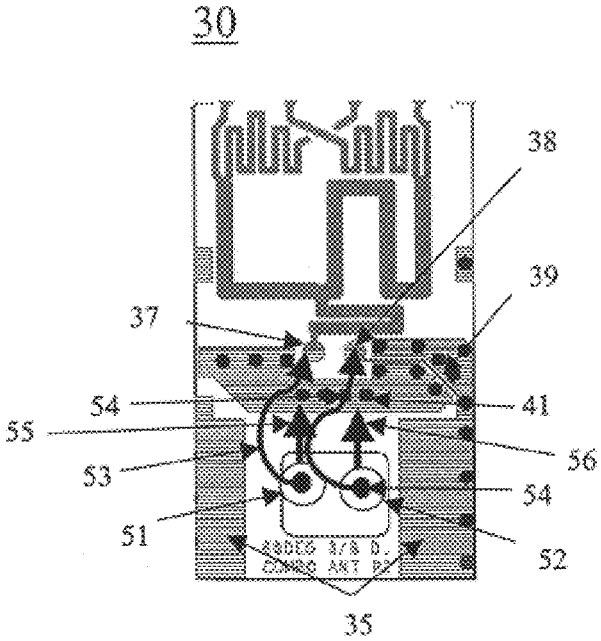
FIG. 5 is an expanded view of a bottom portion of the flexible substrate of FIG. 3 in accordance with the present invention.
Figure 6:
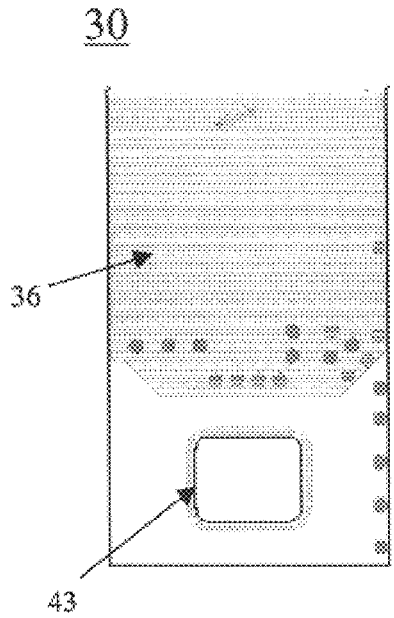
FIG. 6 is an expanded view of a bottom portion of the flexible substrate of FIG. 4 in accordance with the present invention.

Referring to FIGS. 5 and 6, an expanded view of respective FIGS. 3 and 4 are shown. The antenna 30 further comprises an aperture 43 in the flexible substrate 50 for cable routing such as coaxial cables. For instance the combination antenna 30 can further comprise a first coaxial cable 51 having a center conductor 53 coupled to a quadrifilar feed point 37 on the quadrifilar antenna and a first shield 55 coupled to the ground plane and a second coaxial cable 52 having a center conductor 54 coupled to a linearly polarized or monopole feed point 38 on the antenna with linear polarization and a second shield 56 coupled to the ground plane. As noted above, the linearly polarized antenna runs vertically down from the feed point and away from the ground plane utilizing a transmission line 39 as shown. Note that a cable ground solder area 41 is shown for coupling with the first shield and the second shield and that the cable ground solder area 41 couples to the ground plane 36 once the flexible substrate 50 is formed in a tube.

Figure 7:
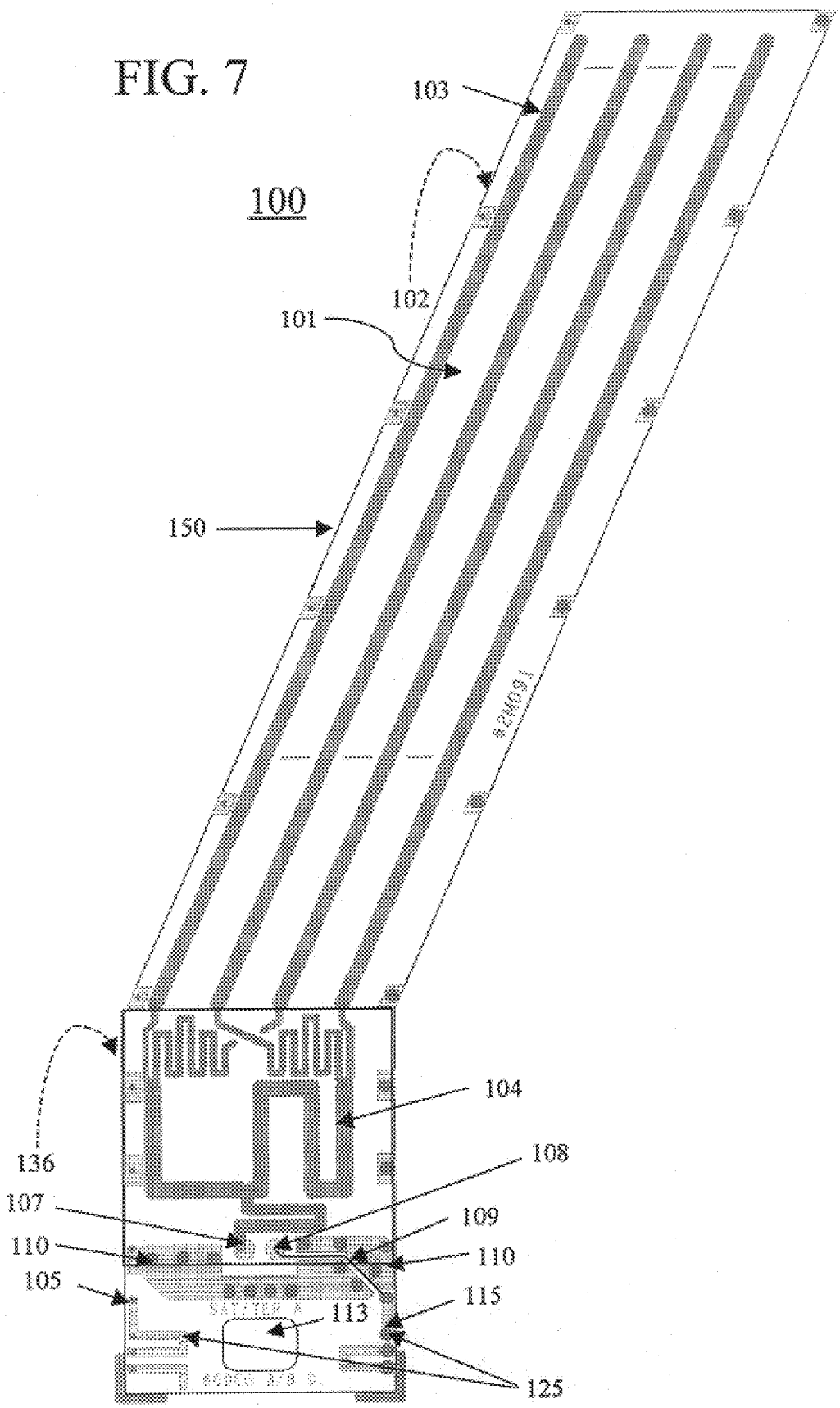
FIG. 7 is a front plan view of an alternative embodiment of a flexible substrate used for a combined linearly polarized and quadrifilar antenna in accordance with the present invention.

Referring to FIG. 7, an alternative embodiment of the present invention similar to antenna 30 of FIGS. 3–6 where a front plan view of a front side 101 of a substrate 150 used for a combination linearly polarized antenna and quadrifilar helix antenna 100 is shown. The antenna preferably comprises a quadrifilar antenna 103 with a feed network 104 etched on a first or top portion of the flexible substrate 150. The quadrifilar antenna 103 in this instance preferably has radiating members that are not folded and formed in parallel fashion to form a helical once the flexible substrate 150 is formed into a tube. The antenna 100 further preferably comprises an antenna with linear polarization 125 such as the monopole in the form of a meandering line etched in two or more sections (105 and 115) on a second or bottom portion of the flexible substrate 150. Section 105 joins with section 115 once the flexible substrate is formed into a tube to form the meandering line monopole antenna 125. It should be noted that the meandering line monopole antenna can be ideally suited and constructed for reception of terrestrial signals such as those currently used for cellular systems, but the invention is certainly not limited thereto. The antenna 100 also comprises a ground plane 136 on a back side or opposing side 102 of the flexible substrate 150 that is common for the quadrifilar antenna 103 and the antenna with linear polarization 125. The ground plane is etched on the flexible substrate and preferably on the opposing side 102 of the substrate 150. The combination antenna 100 is arranged and constructed to fold to form at least a portion of a tube and wherein the antenna with linear polarization and the ground plane have uncoupled portions that become coupled once the combination is folded around to form the tube. Once formed in a tube, the monopole antenna can be formed below the quadrifilar antenna, wherein the monopole and the feed network share a common ground plane and wherein the monopole is at least partially below the common ground plane.

The antenna 100 further preferably comprises an aperture 113 in the flexible substrate 150 for cable routing for cables such as coaxial cables. Coaxial cables (not shown) would be coupled to a quadrifilar feed point 107, a linearly polarized or monopole feed point 108 and a cable ground area 110 as similarly described with respect to items 37, 38, and 41 respectively of FIG. 5. As with antenna 30 of FIGS. 3–6, the linearly polarized antenna 125 runs vertically down from the feed point 108 and away from the ground plane 136 utilizing a transmission line 109 as shown. Also note (as previously described with respect to antenna 30) that the cable ground solder area 110 couples to the ground plane 136 once the flexible substrate 150 is formed into a tube.

As previously mentioned, although the present invention is described with several exemplary embodiments, variations using an unfolded quadrifilar or a non-flexible substrate or a dipole instead of a monopole for example would still provide excellent performance and should be contemplated and interpreted within the scope of the present invention. Finally, it should be noted that the embodiments described herein should not limit the scope of the invention. For example, it should be noted that the quadrifilar antenna in accordance with the present invention can be tuned to receive signals not only for Satellite Digital Audio Radio System (SDARS) signals, but also global positioning satellite signals, or other suitable satellite signals. Likewise, the linearly polarized antenna in accordance with the present invention can be tuned to receive not only signals from SDARS terrestrial repeaters, but also cellular signals, paging signals, FM radio signals, AM radio signals, or other suitable signals for reception by the linearly polarized antenna.

The description above is intended by way of example only and is not intended to limit the present invention in any way except as set forth in the following claims.

What is claimed is:

1. A combination linearly polarized antenna and quadrifilar helix antenna, comprising:

a flexible substrate;

a quadrifilar antenna with a feed network etched on a first portion of the flexible substrate;

an antenna with linear polarization etched on a second portion of the flexible substrate; and a ground plane for the quadrifilar antenna and the antenna with linear polarization etched on the flexible substrate.

2. The combination antenna of claim 1, wherein the antenna with linear polarization is a monopole antenna.

3. The combination antenna of claim 2, wherein the monopole antenna is a meandering line monopole antenna.

4. The combination antenna of claim 1, wherein the flexible substrate further comprises an aperture for cable routing.

5. The combination antenna of claim 1, wherein the quadrifilar antenna and the antenna with linear polarization are etched on a first side of the flexible substrate and a substantial portion of the ground plane is etched on an opposing side of the flexible substrate.

6. The combination antenna of claim 5, wherein combination antenna is arranged and constructed to fold to form at least a portion of a tube.

7. The combination antenna of claim 6, wherein the antenna with linear polarization and the ground plane have uncoupled portions that become coupled once the combination is folded around to form the tube.

8. The combination antenna of claim 1, wherein the combination antenna further comprises a first coaxial cable having a center conductor coupled to a quadrifilar feed point on the quadrifilar antenna and a first shield coupled to the ground plane and a second coaxial cable having a center conductor coupled to a monopole feed point on the antenna with linear polarization and a second shield coupled to the ground plane.

9. The combination antenna of claim 1, wherein the quadrifilar antenna is a folded quadrifilar antenna.

10. The combination antenna of claim 1, wherein the first portion is the top portion of the flexible substrate and the'second portion is a bottom portion of the flexible substrate.

11. A combination monopole and quadrifilar helix antenna, comprising:

a quadrifilar antenna having a feed network;

a monopole antenna arranged below the quadrifilar antenna, wherein the monopole and the feed network share a common ground plane and wherein the monopole is at least partially below the common ground plane.

12. The combination antenna of claim 11, wherein combination antenna comprises a flexible substrate having the quadrifilar antenna and the monopole antenna etched on a first side of the flexible substrate and a substantial portion of the ground plane etched on an opposing side of the flexible substrate.

13. The combination antenna of claim 12, wherein combination antenna is arranged and constructed to fold to form at least a portion of a tube.

14. The combination antenna of claim 13, wherein the monopole antenna and the ground plane have uncoupled portions that become coupled once the combination antenna is folded around to form the tube.

15. The combination antenna of claim 11, wherein the combination antenna further comprises a first coaxial cable having a center conductor coupled to a quadrifilar feed point on the quadrifilar antenna and a first shield coupled to the ground plane and a second coaxial cable having a center conductor coupled to a monopole feed point on the monopole antenna and a second shield coupled to the ground plane.

16. The combination antenna of claim 11, wherein the quadrifilar antenna is a folded quadrifilar antenna.

17. A method of manufacturing a combination monopole and quadrifilar antenna, comprising the steps of:

forming a quadrifilar antenna pattern with a feed network on at least a first plane of a flexible substrate;

forming a monopole antenna pattern on at least the first plane of the flexible substrate; and forming a ground plane pattern on at least a substantial portion of a second plane of the flexible substrate.

18. The method of claim 17, wherein the step of forming a quadrifilar antenna pattern comprises forming a folded quadrifilar antenna pattern.

19. The method of claim 17, wherein the step of forming the monopole antenna pattern comprises the step of folding the combination antenna to form a tube in order to have uncoupled portions of the monopole antenna pattern coupling.

20. The method of claim 17, wherein the step of forming the ground plane pattern comprises the step of folding the combination antenna to form a tube in order to have uncoupled portions of the ground plane pattern coupling.

21. The method of claim 17, wherein the method further comprises the step of folding the flexible substrate onto at least a portion of itself to couple uncoupled portions of the ground plane pattern and to couple uncoupled portions of the monopole antenna pattern.

22. The method of claim 17, wherein the method further comprises the step of forming at least one aperture in the flexible substrate to enable cable routing through the at least one aperture and further comprises the step of forming at least one via through the flexible substrate to enable coupling of uncoupled portions of the ground plane pattern and enable coupling of uncoupled portions of the monopole antenna pattern.

* * * * *